US006039051A

United States Patent [19]

Dorf

[11] Patent Number: 6,039,051

[45] Date of Patent: Mar. 21, 2000

[54] COSMETIC BRUSH

[76] Inventor: Paula Dorf, 205 W. End Ave., Ste. 9J, New York, N.Y. 10023

[21] Appl. No.: 09/272,230

[22] Filed: Mar. 18, 1999

[51] Int. Cl.[7] ..... A45D 44/18; A46B 11/00

[52] U.S. Cl. ..... 132/313; 15/207.2

[58] Field of Search ..... 132/313, 200, 132/308, 901, 150; 15/DIG. 5, 207.2

[56] References Cited

U.S. PATENT DOCUMENTS 3,549,266 12/1970 Vasas ..... 132/313
4,590,637 5/1986 Marino ..... 15/160
4,730,361 3/1988 Koffler ..... 15/160
5,220,702 6/1993 Howell et al. ..... 15/160
5,507,063 4/1996 Hirsch ..... 15/160
5,588,447 12/1996 Gueret ..... 132/200

*Primary Examiner*—John J. Wilson
*Assistant Examiner*—Robyn K. Doan
*Attorney, Agent, or Firm*—Ward & Olivo

[57] ABSTRACT

A makeup brush is provided which facilitates application of blush or rouge to the cheeks. The brush head is configured such that the tuft is less thick than wide. The approximate length of the bristles vary across the width from a shorter side to a longer side. At each side of the width is a curved or tapered portion is formed.

6 Claims, 5 Drawing Sheets

COSMETIC BRUSH

FIELD OF THE INVENTION

This invention relates to an improved applicator for makeup. Specifically, the invention relates to a brush designed for efficient and consistent application of blush to the cheeks. This is achieved by a brush bristle configuration having a certain shape, which is both designed to complement the naturally occurring shape of the face and to provide an even, consistent and symmetrical distribution of blush powder or cream.

BACKGROUND OF THE INVENTION

To achieve a smooth, attractive and balanced application of cheek makeup, commonly known as blush or rouge, it is necessary to carefully apply the cosmetic such that the proper amount is applied, it is evenly distributed, and balanced among the left and right cheek. Also, it must be shaded in such a manner as to define the shape and definition of the structure of the cheeks rather than decorate them with distinct shades of color.

A common problem is the over-application of makeup. When excess cosmetic is applied, a very unnatural look results. To many, this is undesirable. Since blush is intended to color and to define and to add the visual effect of a certain shape with the appropriate color and location of the blush, over-application of cheek blush is particularly undesirable.

The ideal blush application will define and add structure to the face by highlighting and shadowing certain portions of the cheek. A particularly desired look is natural, sun-kissed and emulates the look of a freshly pinched cheek on the apple of the cheek. The apple is the hemisphere which is created by a broad smile, above the cheekbone and centered below of the eye.

Various blush compositions are well known in the art. For example, one type of blush is in the form of a blush stick and is formulated by Mana Products., Inc., and contains the following ingredients: octyl palmitate, cetyl dimethicone, caprylic/capric triglyceride, C12–15 alkyl octanoate, nylon-12, silica, propylene glycol laurate, beeswax, candelilla (euphorbia cerifera) wax, ozokerite, boron nitride, octyldodecanol, dimethicone, cetyl palmitate, aloe barbadensis extract, retinyl palmitate, tocopheryl acetate, tocopherol, ascorbyl palmitate, and propylparaben. The composition may also include iron oxides, titanium dioxide, mica, bismuth, oxychloride, manganese violet, ultramarines, carmine, D&C red #6, D&C red #7 calcium lake, D&C red #27, D&C red #28 aluminum lake, FD&C yellow #5 aluminum lake, FD&C yellow #6 aluminum lake, and/or FD&C blue #1 aluminum lake.

Various types of applicators can theoretically be used to apply blush, including bristle brushes, fingers, and sponge or other type of padded applicators. However, all have practical drawbacks. For example, all will deposit the cosmetic as a defined stripe or spot or result in a streaked application. One may be able to vary the pressure or stroke in their application to prevent spots or streaking, but it is then difficult to provide the makeup in the proper locations.

Various types of brushes have been used which attempt to overcome this problem. Certain brushes for applying blush are designed with a rounded bristle configuration. An example of such a brush is depicted in FIG. 1 as brush 91. Brush 91 has a handle 11, a ferrule 21 and a tuft 31. In the prior art brush depicted in FIG. 1, the ferrule is generally frustum. That is, the line 26 at which the ferrule ends and the bristle become exposed is circular, and the line 16 at which the ferrule begins and the exposed handle ends is also circular, where the circle represented by the line 26 is larger than the circle represented by line 16. The tuft 31 is also partially frustum with a hemispherical shape at the top 36 of the tuft 31. Such a brush, if used properly with even and level brush strokes, may provide an even layer of cheek blush. Such a brush is meant to be used by dusting using an upward motion along your cheekbone. The brush in FIG. 1 will fail to hug the cheek and results in an uneven application and a clown-like look, and is inefficient because of a longer application time and more product waste.

Another brush, meant to be used along with the brush described above and depicted in FIG. 1, is depicted in FIG. 2. Brush 92 has a handle 12, ferrule 22 and a tuft 32. Unlike the ferrule of the brush depicted in FIG. 1, the ferrule 22 of this prior art brush is cylindrical. This type of brush has an angled flat tuft 32. That is, the tip 42 of tuft 32 is generally circular, and where the circumference of that circle meets with the sides of the brush head a sharp angle is created. This type of brush is used to blend the edges that are typically created with the brush depicted in FIG. 1. These edges may be created because of the dusting motion. That is, the initial light tap is towards the cheekbone, then "dusted" upwards. The step is repeated across the cheek (typically, from the hairline near the ear to the apple of the cheek). The brush in FIG. 2 adds to the blush application time and increases product waste.

Heretofore, there has not been provided a cheek blush brush which performs all the functions of the prior art brushes. That is, prior to the invention herein, there has not been a cheek brush which is shaped so that blush can be applied in a manner using the proper quantity, applying the proper stroke width, and having soft edges which blend with the rest of the face not having blush.

OBJECTS OF THE INVENTION

In light of the above described deficiencies in cheek brushes for the application of blush, the invention herein has a primary object of performing the functions of all of the above mentioned brushes with a single brush.

Specifically, it is an object of the invention to provide a cheek brush which allows for a the proper amount of blush to be applied.

It is a further object of the invention to provide a cheek brush which facilitates an even application of blush to both sides of the face.

It is a further object of the invention to provide a cheek brush which provides the proper fading and blending at the edges of the blush streak so that the proper shadow is obtained.

Finally, it is an object of the present invention to provide a cheek brush which performs all of the aforementioned objects allowing one to apply blush quickly and precisely by minimizing or eliminating a need for touch-up or extra blending of the blush.

SUMMARY OF THE INVENTION

The present invention is directed to a makeup brush having an curved tuft. Specifically, the makeup brush of the present invention is a cheek brush with a head that is less thick than wide, and whereupon the height of the bristles is higher at one side of the width than the at the opposite side of the width, and further whereupon each side of the width forms a curved or tapered portion. A preferred embodiment of the present invention is described herein with references to the accompanying figures.

DETAILED DESCRIPTION OF THE INVENTION

With specific reference to the drawings briefly described above, a detailed description of the makeup brush comprising the present invention is described herein.

Figure 1:
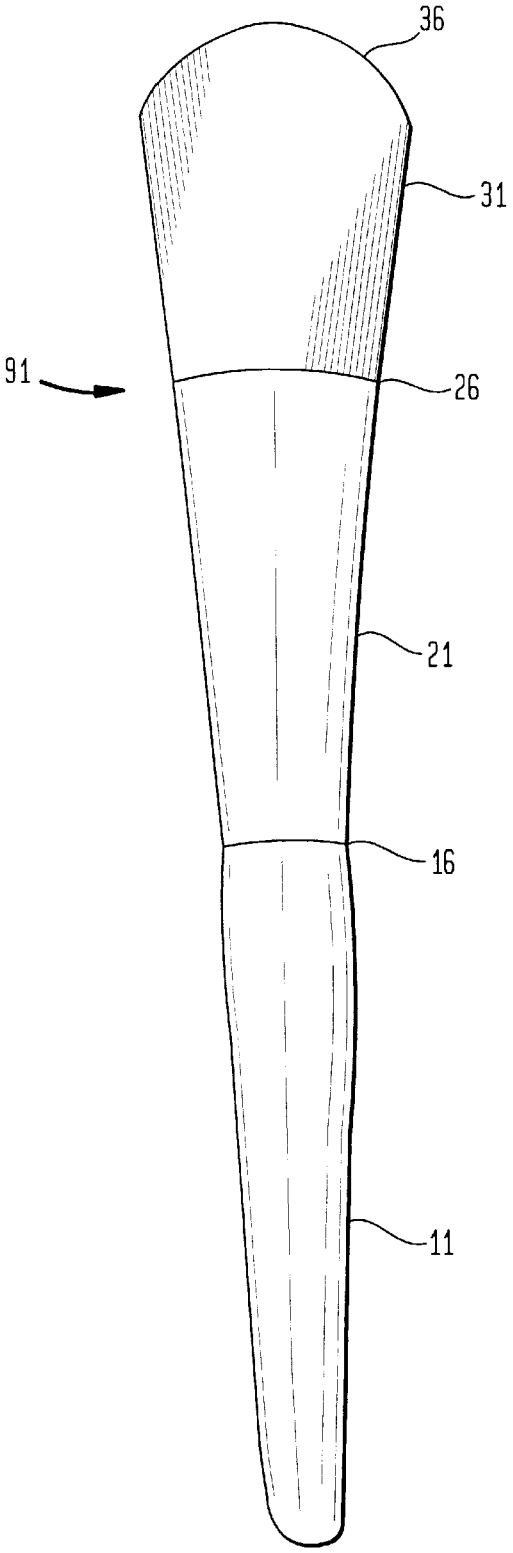
FIG. 1 (PRIOR ART)
FIG. 1 depicts a blush brush of the prior art.
Figure 2:
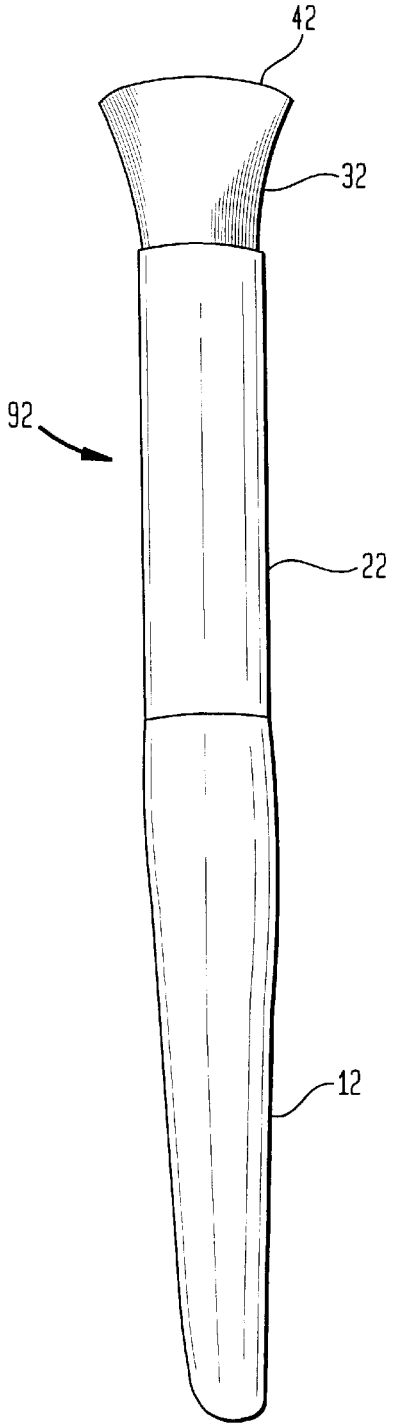
FIG. 2 (PRIOR ART)
FIG. 2 depicts a contoured brush of the prior art.
Figure 3A:
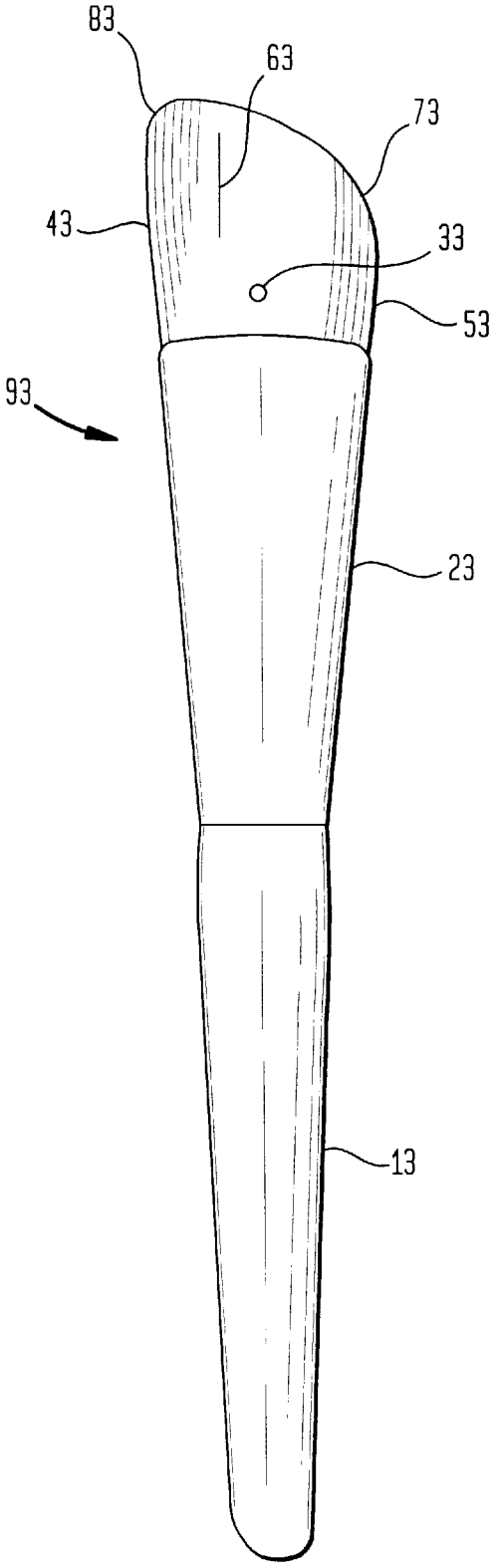
FIG. 3A depicts a plan view of a brush which is an embodiment of the present invention.
Figure 3B:
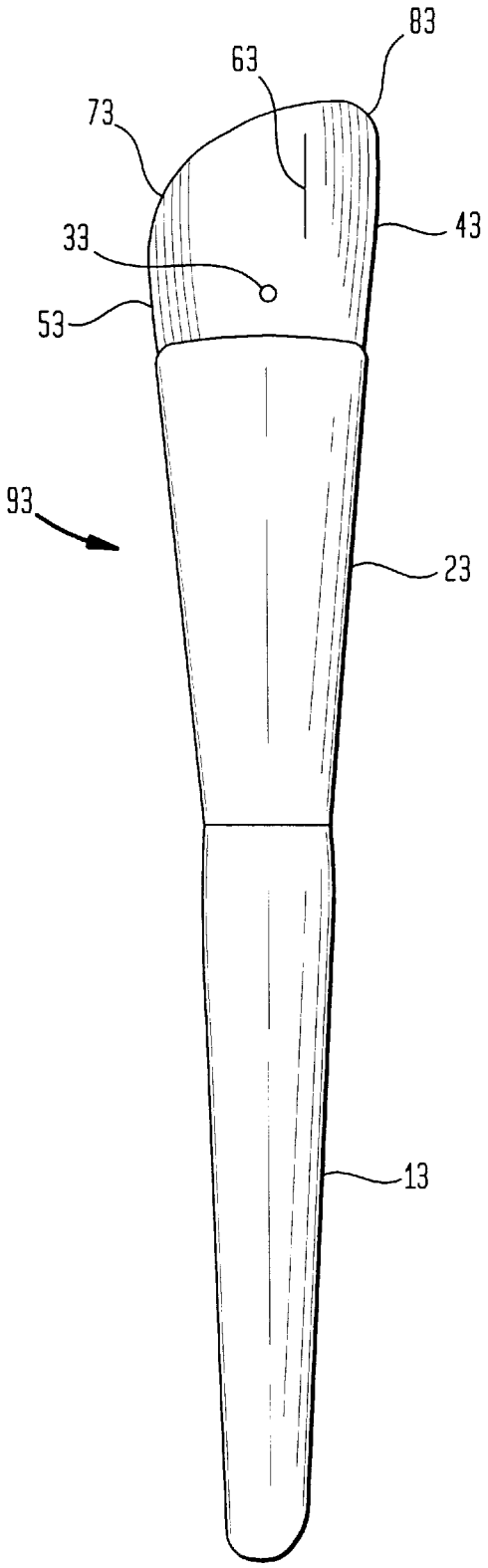
FIG. 3B depicts a plan view of the opposing side of the brush depicted in FIG. 3A.

FIGS. 3A and 3B depict a brush 93 of the present invention. The brush 93 comprises a handle 13, a ferrule 23 and a tuft 33. Tuft 33 is comprised of a plurality of bristles 63 of varying length and direction. Bristles 63 generally extend in a parallel direction in relation to the ferrule. Tuft 33 is depicted in FIGS. 3A and 3B with reference to short side 53, long side 43, low corner 73 and high corner 83. Both FIGS. 3A and 3B are provided to show that when viewing either side of brush 93, the configuration of the handle, ferrule and tuft is the same except that view of tuft 34 is opposing.

Handle 13 may be constructed of any suitable material, and generally is constructed of a type of wood. However, the present invention encompasses any handle material which may be suitable. Such materials may include any type of plastic or resin, metal, ceramic, or any other material which may be adapted as a brush handle.

Additionally, the shape of handle 13 is not limited to that shown in FIGS. 3A or 3B or any other drawing herein. As shown in FIGS. 3A and 3B, handle 13 is generally cylindrical with a tapered end (the point furthest from the tuft). However, the handle may include, for example, indentations about the circumference of the handle, longitudinal groves along the handle, any type of rounded ornamental or functional object at the end of handle 13, or any other device or configuration adapted to facilitate holding the brush or provide ornamental enhancement.

Figure 4:
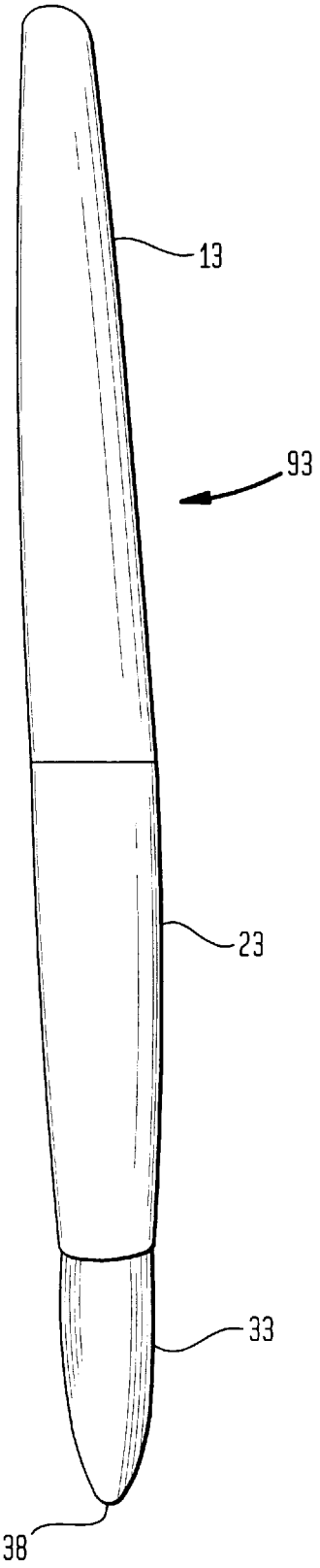
FIG. 4 depicts a side view of a brush which is an embodiment of the present invention.

Furthermore, while a traditional ferrule has been shown and referenced, any means for attaching the bristles to the handle of a brush may be used. The ferrule shown in the brush of FIGS. 3A and 3B may be a common metal such as tin, steel, nickel, aluminum, or any alloy thereof. Additionally, it may be a plastic having suitable properties. The important part of ferrule 23 as shown in FIGS. 3A, 3B and 4 is the tapered cross section. That is, at the juncture of the ferrule and the handle the ferrule is generally cylindrical having a circular cross-section. At the juncture of the ferrule and the tuft, the ferrule has an oval cross section. This corresponds with the cross-section of the tuft at the juncture of the ferrule and the tuft.

A non-traditional attachment means is also contemplated by the present invention. That is, any means of attaching a tuft to a handle of a brush is contemplated as being encompassed by the present invention, so long as the oval cross-section at the base of the tuft is accomplished.

FIG. 4 is provided to show a side view of the brush described with reference to FIGS. 3A and 3B. FIG. 4 depicts brush 93 having handle 13, ferrule 23 and tuft 33. Of particular interest in FIG. 4 is the tip 38 of tuft 33. It is shown as coming to a rounded point. That is, the bristle length is varied so that across the thickness of the tuft, bristle lengths are a predetermined minimum length, then are progressively longer to a predetermined maximum length and then become shorter to generally the same predetermined minimum length.

Figure 5:
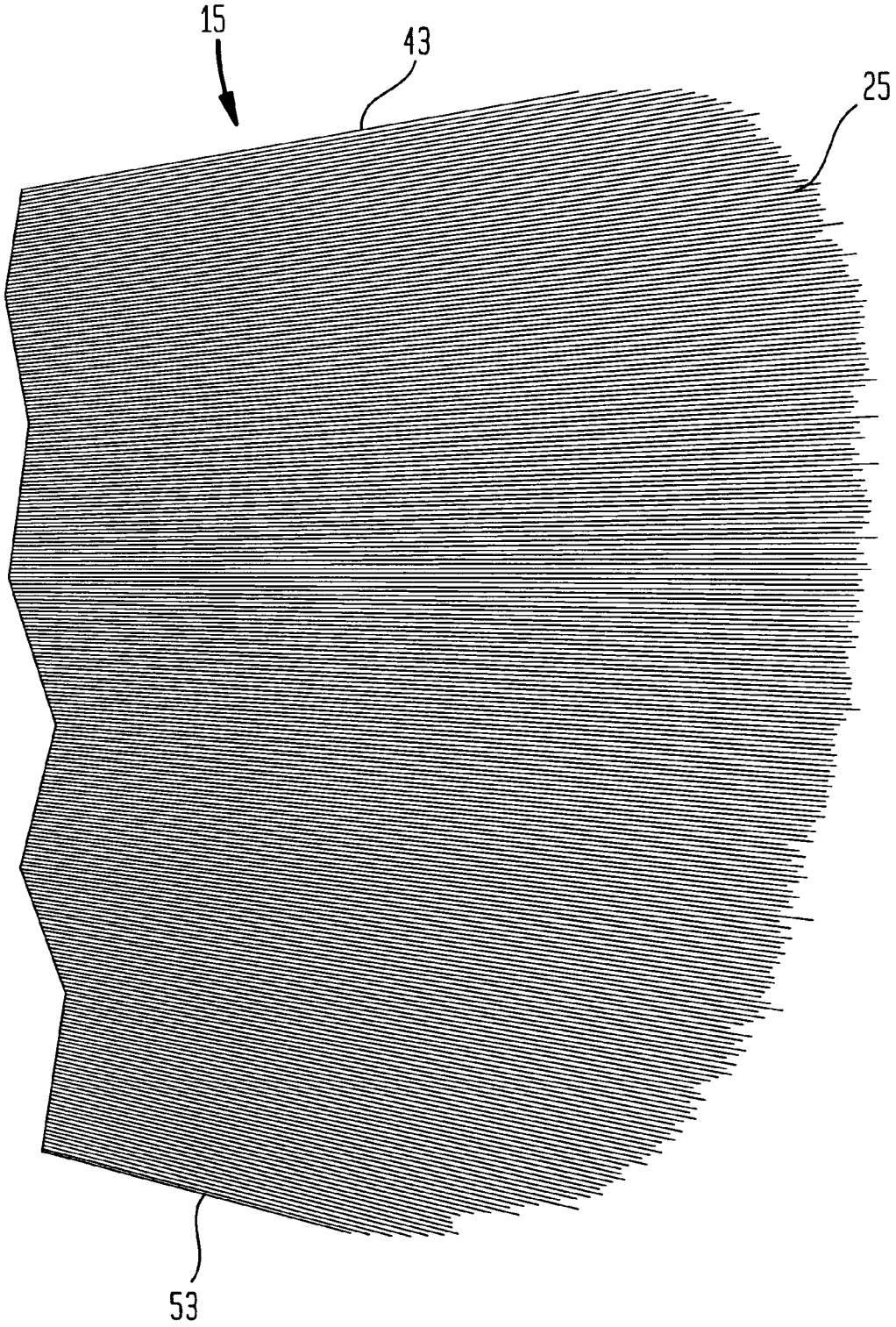
FIG. 5 is an exploded front plan view of the bristle configuration of a brush which is an embodiment of the present invention.

Across the width of the tuft the bristle length also varies. This variation in bristle length across the width of the tuft provides the curved shape of the tuft as described briefly above. However, it should be noted that the bristles are not necessarily formed so that the lengths are uniformly varied. That is, adjacent bristles may vary. FIG. 5 depicts an exploded view of the bristles. This demonstrates an embodiment of the present invention wherein adjacent bristles of tuft 15 may be of varying lengths. For example, bristles 25 are shown as being of varying length, even though as a group they are approximately the same length in comparison to a group of bristles at another point, for example closer to edge 53 of the tuft. This slight length variation is provided to simplify manufacturing (i.e., ultra-precision is not required), to give the tuft a softer feel across the skin (since fewer bristles are in contact with the skin at a higher pressure and more are in contact at a lower pressure, giving a tickling sensation) and to allow for a smoother application of makeup powder or cream.

Figure 6:
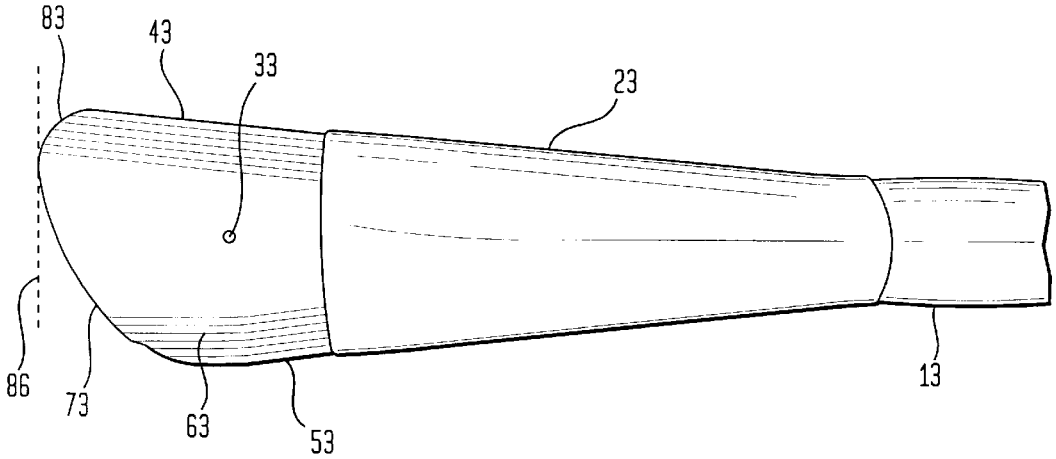
FIG. 6 is an enlarged view of the ferrule and tuft of a brush which is an embodiment of the present invention.

The shape of the tuft is best depicted in FIG. 6. FIG. 6 depicts a portion of handle 13, ferrule 23 and tuft 33. Tuft 33 is shown with reference to short side 53, long side 43, low corner 73 and high corner 83. Additionally, line 86 is shown which represents a tangent line from the outermost extending portion of the curved high corner 83. This line represents the portion of the brush which is intended to contact the apple of the cheek. Thus, when used properly, the portion of the brush extending to line 86 is in contact with the apple of the cheek, while the low corner 73 is in contact with the face below the apple (i.e., closer to the mouth).

Figure 7:
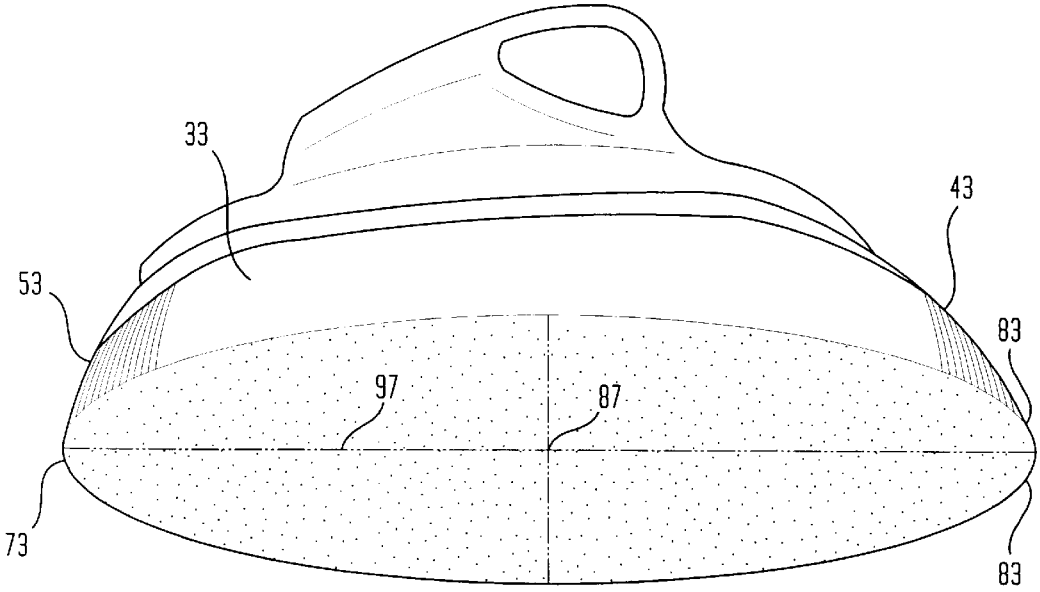
FIG. 7 is a perspective top view of the tuft of a brush which is an embodiment of the present invention.

A view of the tip of the tuft is depicted in FIG. 7. FIG. 7 depicts tuft 33 having short side 53, long side 43, low corner 73 and high corner 83. As depicted, the tip generally has a oval cross-section. The tuft has a thickness 87 and a width 97. In a preferred embodiment of the present invention, the thickness 87 is approximately 9 mm and the width 97 is approximately 21 mm. However, it is contemplated that the dimensions may vary according to the size of one's face. Also, the ratio of width to thickness may also vary for personal preference or to accommodate different makeup application needs.

When using the brush of the present invention for the application of cheek blush, the shape of the tuft facilitates alignment of the brush with the face. That is, the portion of the tuft extending to line 86 contacts the apple of the cheek with the low corner 73 in contact with the face below the apple. The brush handle should be held in a substantially horizontal position, so that the tuft is substantially vertical with the long side of the tuft 43 higher on the face and the short side of the tuft 53 lower on the face. When so positioned, application of the blush is facilitated. The brush is swept horizontally from the starting point (the apple) to the hairline of the face (closest to the ear), generally following the contour of the cheekbone. This allows for a precise application of the blush, since there is no need for vertical sweeps as with the prior art blush brushes. Furthermore, as the stroke direction is horizontal rather than vertical, the brush embodied herein simplifies application of blush in a balanced manner. That is, it is easier to apply blush to the left and right sides of the face symmetrically.

The curved angle portions 73 and 83 serve a purpose of limiting the quantity of blush applied to the portion of the face above the apple (corresponding to high corner 83 when the brush is positioned correctly) and at the lower portion of the blush streak on the cheek (corresponding to low corner 73 when the brush is positioned correctly).

Also, the rounded point shown in FIG. 4 as reference numeral 38 serves the purpose of preventing clumping at the start and finish of an individual brush stroke. That is, when the sweep is started, the outermost part of the tip 38 is in contact with the apple, and the remainder of the bristles are farther away from the skin. Thus, the start point is faded from the point where the shorter bristles (across the thickness of the tuft) contact the skin to the point where the longer bristles contact the skin. The bristles may be made of any material suitable for the makeup to be used. For example, blush cream is generally pressed to a solid form. As such, synthetic nylon or Taklon bristles are suitable for use with a solid blush cream. These synthetic bristles are typically stiffer than their natural counterparts, which allow for the user to sweep the brush across the solid cream to obtain cosmetic on the brush, which can then be applied to the face.

The tufts of makeup brushes can also be fabricated from natural hair. Natural hair brushes are typically used for powders. Thus, for the application of blush powder, the tuft on the brush of the present invention can be formed of squirrel hair, sable hair or pony hair, for example. In a preferred embodiment, the tuft is made of squirrel hair as it is typically the softest of the group, therefore applicable for powder blush.

The brush of the present invention may be cleaned by any method known in the art. For example, various products have been marketed for the specific purpose of cleaning makeup brushes. One such product is Brush-Out™, which is a composition of water, hexylene glycol, aloe vera gel, camomile extract, sodium PCA, sodium trideceth sulphate, PVP, imidezoudinyl urea, methyl paraben and sodium borate. Also, one may use conventional hair shampoo to wash the brush tuft.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A brush comprising:

a handle;

a ferrule, wherein a base portion of said ferrule is secured to said handle and a periphery portion of said ferrule having an substantially elliptical cross-section; and a tuft having a plurality of bristles, said tuft further having a root portion and a tip portion, said root portion being anchored in said ferrule, and said tip portion having a generally elliptical cross-section having two lateral edge portions, a longitudinally extending center region and two longitudinal edge portions;

wherein the distance between said edge portions of said tip portion is approximately 9 mm and the distance between said longitudinal edge portions of said tip portion is aproximately 21 mm;

wherein said plurality of bristles have distances from an outer portion of said ferrule which approximately vary such that lengths from the outer portion of said ferrule to the tip portion increase from the lateral edge portions of the elliptical cross-section of said tip portion to said longitudinally extending center region of the elliptical cross-section of said tip portion, and further wherein said plurality of bristles have lengths from the outer portion of said ferrule to the tip portion which approximately vary such that the lengths from the outer portion of said ferrule to the tip portion increase from one longitudinal edge portion to a maximum length and decrease from said maximum length to a minimum length at the other longitudinal edge portion.

2. A brush as in claim 1, wherein said handle has an attachment portion, said attachment portion having a generally circular cross-section, wherein said base portion of said ferrule has a cross-section substantially the same shape as the cross-section of said attachment portion, and further wherein the diameter of said circular cross-section is less than the distance between said two longitudinal edge portions.

3. A brush as in claim 1, wherein said ferrule is constructed of a material selected from the group consisting of tin, steel, nickel, aluminum, an alloy of tin, steel, nickel or aluminum, and plastic.

4. A brush as in claim 1, wherein the distance between said lateral edge portions of said tip portion is approximately 9 mm and the distance between said longitudinal edge portions of said tip portion is approximately 21 mm.

5. A brush as in claim 1, wherein said bristles comprise fibrous strands selected from the group consisting of synthetic nylon, and natural hair.

6. A method of applying cosmetic blush comprising the steps of:

providing a brush having a handle;

a ferrule, wherein a base portion of said ferrule is secured to said handle and a periphery portion of said ferrule having an substantially elliptical cross-section; and a tuft having a plurality of bristles, said tuft further having a root portion and a tip portion, said root portion being anchored in said ferrule, and said tip portion having a generally elliptical cross-section having two lateral edge portions, a longitudinally extending center region and two longitudinal edge portions;

wherein said plurality of bristles have distances from outer portion of said ferrule which approximately vary such that lengths from the outer portion of said ferrule to the tip portion increase from the lateral edge portions of the elliptical cross-section of said tip portion to said longitudinally extending center region of the elliptical cross-section of said tip portion, and further wherein said plurality of bristles have lengths from the outer portion of said ferrule to the tip portion which approximately vary such that the lengths from the outer portion of said ferrule to the tip portion increase from one longitudinal edge portion to a maximum length and decrease from said maximum length to a minimum length at the other longitudinal edge portion;

applying cosmetic blush to the tip portion of said brush;

positioning said tip portion on a side of a human face in a position such that said maximum length of said tip portion in contact with a cheekbone of a human face such that said minimum length of said tip portion is relative to the lower portion of the cheekbone; and sweeping said brush from said position in a direction toward an ear on said of said human face.

* * * * *